US005118081A

United States Patent [19]

Edelman

[11] Patent Number: 5,118,081

[45] Date of Patent: Jun. 2, 1992

[54] VEHICULAR RAMP APPARATUS

[76] Inventor: William J. Edelman, 175 Linda Ave., Hawthorne, N.Y. 10532

[21] Appl. No.: 673,011

[22] Filed: Mar. 21, 1991

[51] Int. Cl.[5] ..... B66F 19/00; E02C 3/00

[52] U.S. Cl. ..... 254/88

[58] Field of Search ..... 254/88; 14/69.5, 71.1; 298/188.2, 346, 352

[56] References Cited

U.S. PATENT DOCUMENTS

| | | | |
|---|---|---|---|
| 1,871,129 | 8/1932 | Pierce | 254/88 |
| 2,420,130 | 5/1947 | Foss | 254/88 |
| 2,450,648 | 10/1948 | Felzer | 254/88 |
| 3,990,681 | 11/1976 | McKeen | 254/88 |
| 4,327,896 | 5/1982 | Whitehead | 254/88 |
| 4,993,685 | 2/1991 | Sparling | 254/88 |

*Primary Examiner*—Robert C. Watson
*Attorney, Agent, or Firm*—Leon Gilden

[57] ABSTRACT

A vehicular ramp including an inclined ramp surface cooperating with a horizontally disposed support plate includes a rear wall, with the rear wall mounting a web roll thereon, the web roll extends downwardly of the rear wall between spaced rear legs and forwardly of the ramp surface underlying a presser plate, wherein the presser plate is pivotally mounted adjacent a forward terminal end of the ramp and extends below the forward terminal end to overlie a web extending from the web roll minimizing abrasive wear to the web roll upon ascent of a vehicle of the ramp structure.

4 Claims, 4 Drawing Sheets

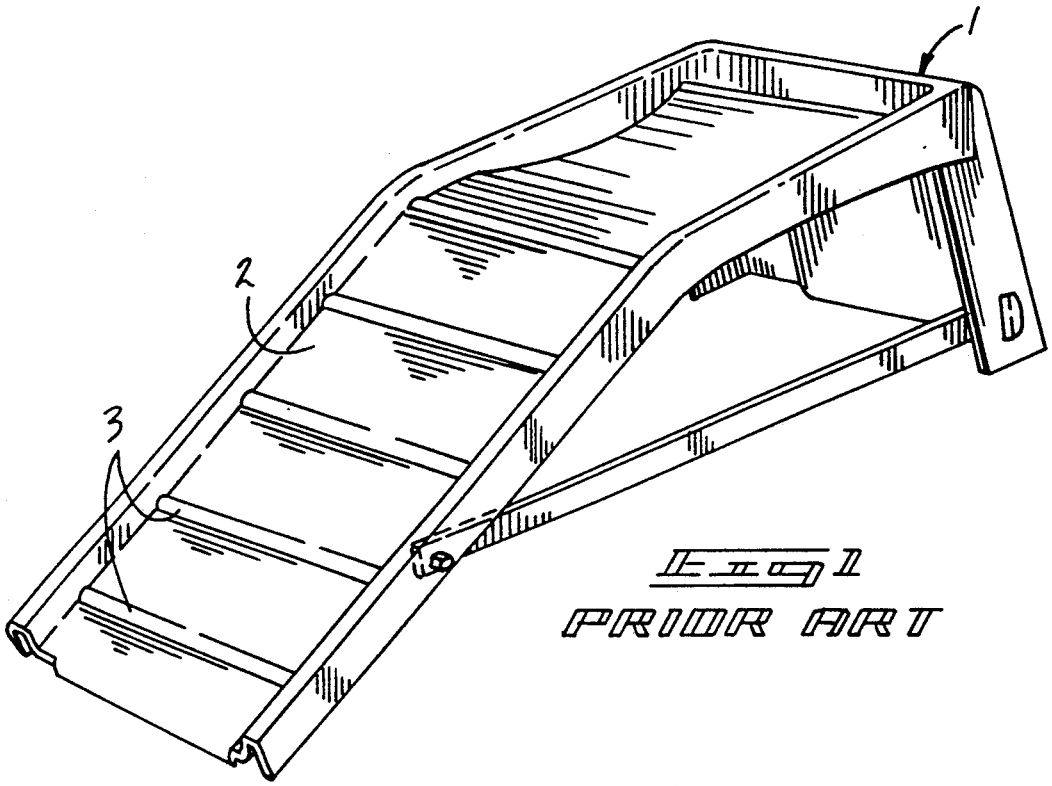
Fig 1
PRIOR ART
Fig 2
PRIOR ART
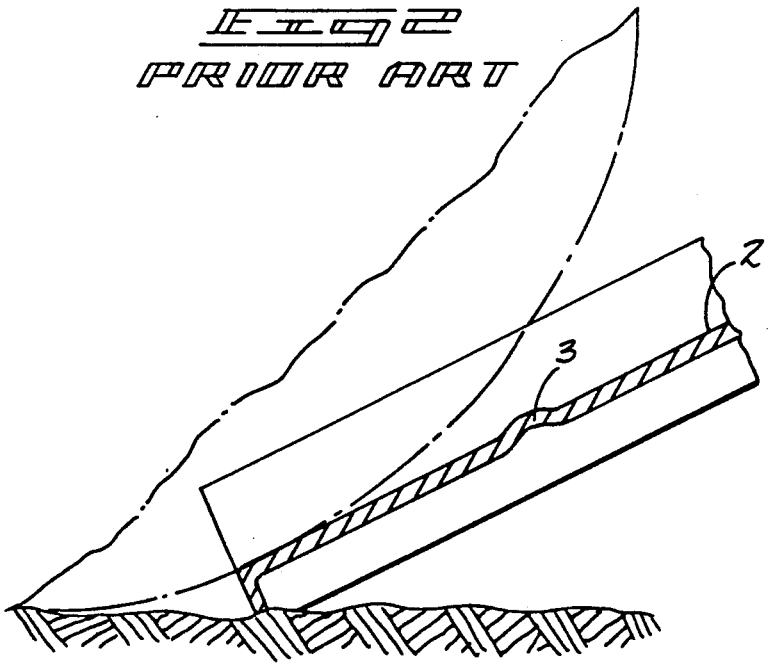

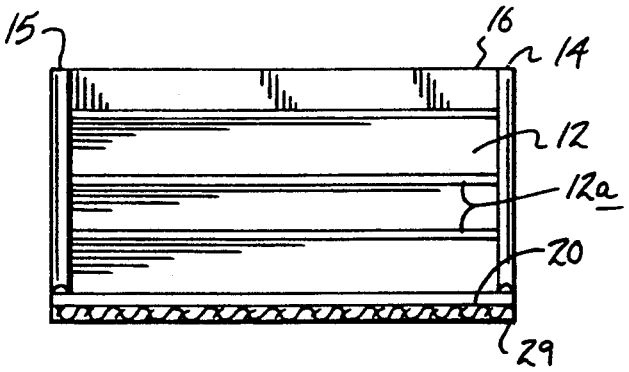
Fig 5
Fig 6
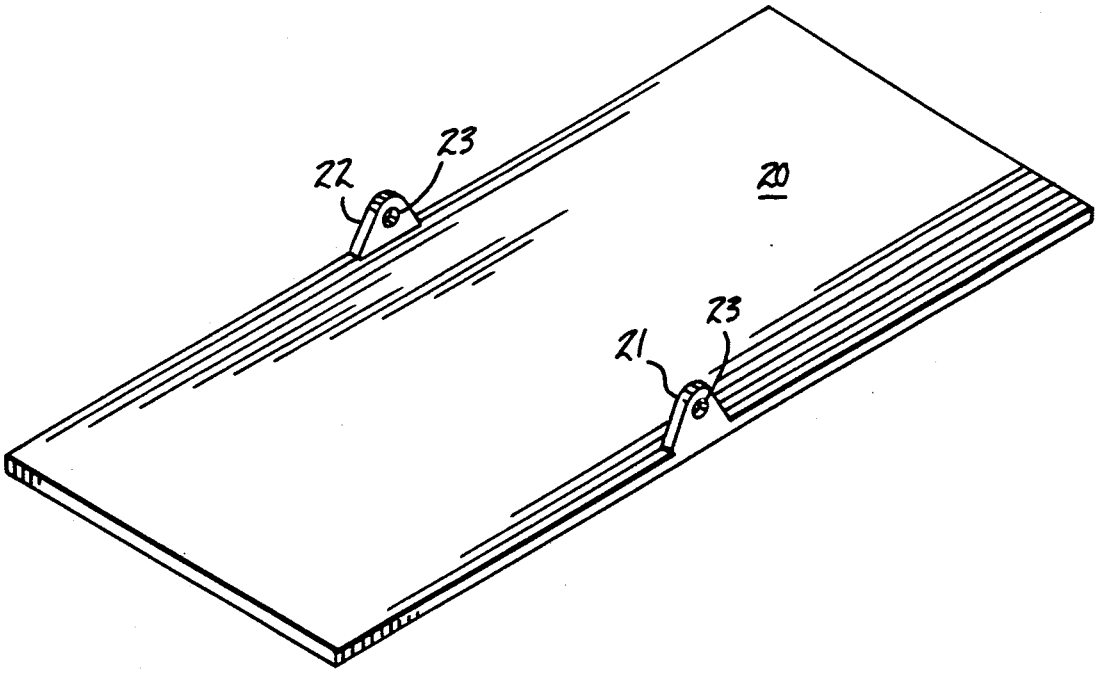

VEHICULAR RAMP APPARATUS

BACKGROUND OF THE INVENTION

1. Field of the Invention

The field of invention relates to automotive ramp apparatus, and more particularly pertains to a new and improved vehicular ramp apparatus wherein the same utilizes a friction web mounted upon a roll and extending below the ramp surface for providing a grasping web for a vehicle ascending the inclined portion of the ramp structure.

2. Description of the Prior Art

Various vehicular ramps of various types have been utilized in the prior art to permit mounting of a vehicle thereon. The web of the instant invention provides a grasping surface to orient the associated ramp relative to the vehicle.

Examples of prior art organizations to provide vehicular ramp structure may be found in U.S. Pat. No. 4,050,403 to Miller wherein the ramp member includes a concave upper portion for accommodating a vehicular wheel therewithin subsequent to ascent of a vehicle over the inclined portion of the ramp organization.

U.S. Pat. No. 4,103,870 to Murakami sets forth a ramp structure utilizing a chain matrix mounted overlying the ramp organization to provide a grasping surface for a vehicle prior to ascent of the ramp.

U.S. Pat. No. 4,371,298 to Van Iperen provides for vehicle ramps providing concave recesses utilizing a frictional surface laminated to the ramp structure for enhanced engagement of the vehicle tire and the ramp in use.

U.S. Pat. No. 4,836,501 to Baer provides a ramp structure utilizing a plurality of planar support surfaces for various selective positioning of the vehicle relative to the ramp organization.

U.S. Pat. No. 4,421,300 to Lundman sets forth a vehicle ramp of conventional construction utilizing a planar ramp portion, with spaced parallel ribs for providing traction of a vehicle climbing the ramp member. The patent addresses the problem of ramps sliding when being mounted.

As such, it may be appreciated that there continues to be a need for a new and improved vehicular ramp apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of vehicular ramp apparatus now present in the prior art, the present invention provides a vehicular ramp apparatus wherein the same utilizes an elongate web selectively and adjustably directed forwardly of the ramp structure for providing a frictional engagement surface for enhanced frictional engagement of a vehicle ascending the ramp organization. As such, the general purpose of the present invention, which will be described subsequently in greater detail, is to provide a new and improved vehicular ramp apparatus which has all the advantages of the prior art vehicular ramp apparatus and none of the disadvantages.

To attain this, the present invention provides a vehicular ramp including an inclined ramp surface cooperating with a horizontally disposed support plate including a rear wall, with the rear wall mounting a web roll thereon, the web roll extends downwardly of the rear wall between spaced rear legs and forwardly of the ramp surface underlying a presser plate, wherein the presser plate is pivotally mounted adjacent a forward terminal end of the ramp and extends below the forward terminal end to overlie a web extending from the web roll minimizing abrasive wear to the web roll upon ascent of a vehicle on the ramp structure. The web is extended to its limit under wheels of vehicle. The vehicle holds the web and the web keeps the ramps from sliding away from vehicle.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vehicular ramp apparatus which has all the advantages of the prior art vehicular ramp apparatus and none of the disadvantages.

It is another object of the present invention to provide a new and improved vehicular ramp apparatus which may be easily and efficiently manufactured and marketed.

It is a further object of the present invention to provide a new and improved vehicular ramp apparatus which is of a durable and reliable construction.

An even further object of the present invention is to provide a new and improved vehicular ramp apparatus which is susceptible of a low cost of manufacture with regard to both materials and labor, and which accordingly is then susceptible of low prices of sale to the consuming public, thereby making such vehicular ramp apparatus economically available to the buying public.

Still yet another object of the present invention is to provide a new and improved vehicular ramp apparatus which provides in the apparatuses and methods of the prior art some of the advantages thereof, while simultaneously overcoming some of the disadvantages normally associated therewith.

Still another object of the present invention is to provide a new and improved vehicular ramp apparatus wherein the same is arranged for providing a frictional web to align and position the ramp relative to a vehicle ascending the ramp structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art automotive ramp apparatus.

FIG. 2 is an orthographic cross-sectional illustration of the inclined ramp portion of the prior art ramp as set forth in FIG. 1.

FIG. 4 is an orthographic rear view, taken in elevation, of the instant invention.

FIG. 6 is an isometric illustration of the presser plate utilized by the instant invention.

FIG. 7 is an isometric illustration of the instant invention in an assembled operative configuration.

DESCRIPTION OF THE PREFERRED EMBODIMENT

Figure 3:
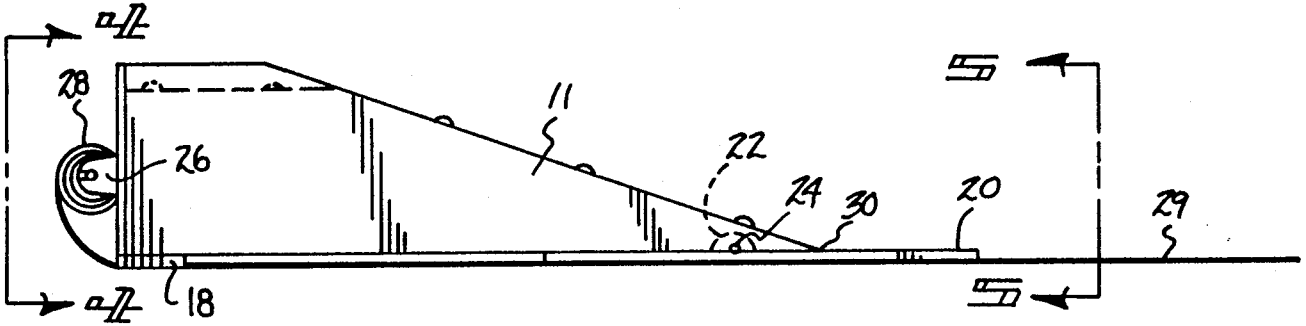
FIG. 3 is an orthographic side view, taken in elevation, of the instant invention.

With reference now to the drawings, and in particular to FIGS. 1 to 7 thereof, a new and improved vehicular ramp apparatus embodying the principles and concepts of the present invention and generally designated by the reference numeral 10 will be described.

FIG. 1 illustrates a prior art vehicular ramp apparatus 1, utilizing a planar ramp 2, utilizing traction ribs 3 of conventional configuration, as set forth in U.S. Pat. No. 4,421,300.

More specifically, the vehicular ramp 10 of the instant invention essentially comprises a framework including spaced parallel side wall 11 fixedly mounting an inclined ramp 12 therebetween. The inclined ramp 12 includes a plurality of spaced parallel traction ribs **12*a* integrally formed to the top surface of the ramp structure. An inclined ramp 12 is integrally mounted to a horizontal top ramp 13 that is coextensive with the inclined ramp 12 and defines an obtuse included angle between the inclined ramp 12 and the horizontal top ramp 13. The inclined ramp 12 is recessed below the side walls 11 to define respective right and left flanges 14 and 15 that project orthogonally above the top surface of the inclined ramp 12. Similarly, a rear flange 16 orthogonally positioned between the right and left flanges 14 and 15 extends above the top ramp 13. The rear flange 16 is defined by an upper portion of the rear wall 17 that is orthogonally and integrally mounted to rear terminal ends of the respective side walls 11. The rear wall 17 includes a plurality of rear support legs 18 that extend below the side walls 11 adjacent the rear wall 17 defining a gap 19 between a lower terminal edge of the rear wall 17 and an underlying support, as illustrated in FIG. 4** for example.

Figure 5:
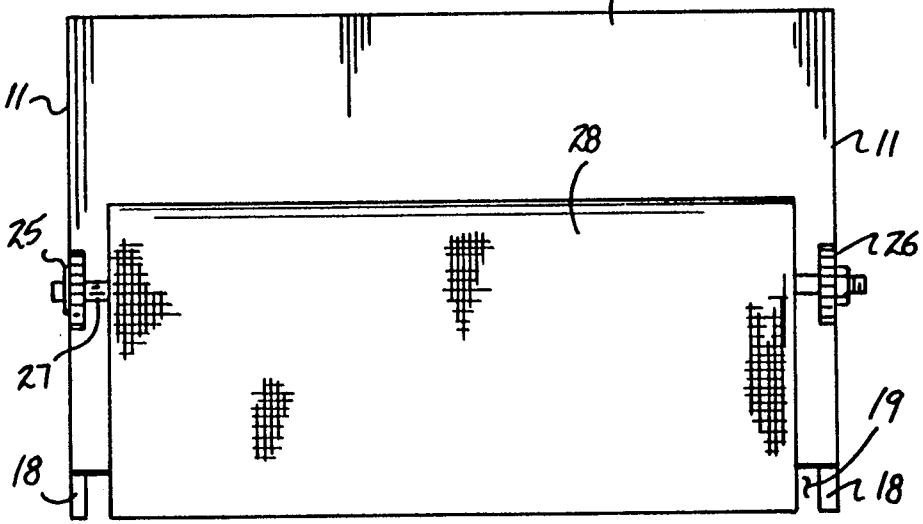
FIG. 5 is an orthographic frontal view, taken in elevation, of the instant invention.
Figure 11:
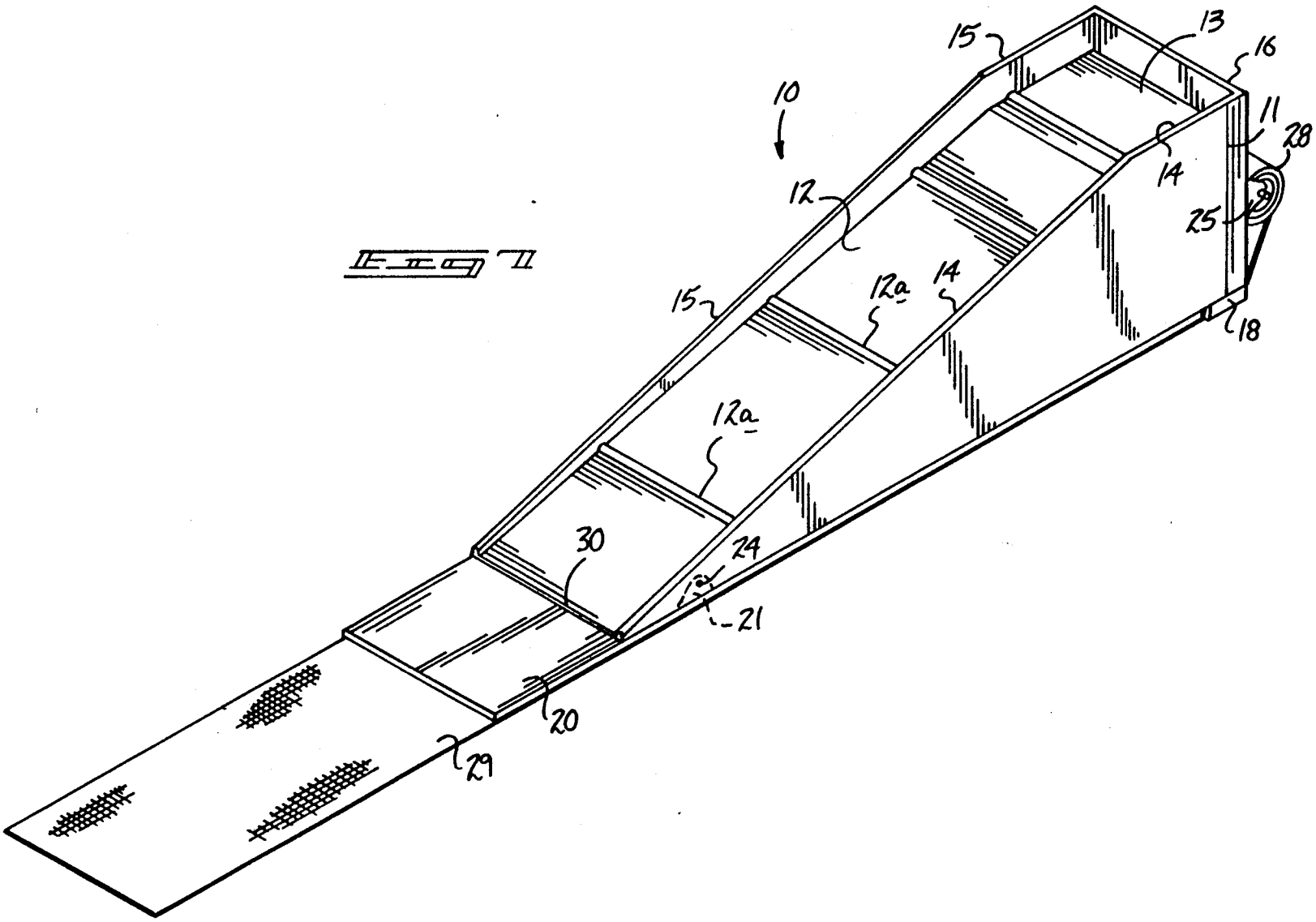

Fixedly mounted to the side walls 11 is a presser plate 20 that is defined by a predetermined width substantially equal to a predetermined width defined between the side walls 11, as illustrated in FIG. 5. The presser plate 20 is longitudinally aligned with the rear support legs 18 and defined by a height substantially equal to a height defined by the rear legs 18. The presser plate 20 further extends beyond a forward ramp edge 30 which serves as a forward terminal edge of the inclined ramp 12, and wherein the forward ramp edge 30 is orthogonally directed between the side walls 11. The presser plate 20 extending beyond the forward edge 30, as illustrated in FIGS. 3 and 7, to be described in more detail below. The presser plate 20 includes a respective right and left ear 21 and 22 orthogonally mounted medially of the presser plate 20 to opposed side edges thereof, wherein each ear includes a cylindrical opening 23 whose axes are coaxially aligned relative to one another, wherein each cylindrical opening mounts a support axle 24 directed through a respective side wall and ear to secure the presser plate to the side walls.

A respective right and left support flange 25 and 26 are positioned medially of side edges of the rear wall 17, wherein the support flanges include a roll support axle 27 that is arranged parallel to the rear wall 17 and orthogonally relative to the side walls 11. The rear support axle 27 rotatably mounts a web roll 28, wherein a fabric web 29 extends from the roll 28 between the rear support legs 18 through the gap 19 and underlies the presser plate 20, whereupon a vehicle minimizes abrasive erosion of the fabric web 29 that would extend beyond the forward ramp edge 30. It is noted that the web 29 is longitudinally aligned relative to the presser plate 20 in use. Further, the presser plate 20 functions as a protection and positioning for the web 29 as the vehicle wheel is directed from a flexible web 29 onto the plate 20 and subsequently directed to ascend the inclined ramp 12 to the top ramp 13. Vehicle wheels hold the web and the web secures and positions the ramps. It prevents the ramp structure from sliding or being displaced from a desired orientation by the vehicle.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

It should be understood accordingly that the proper positioning of the flexible webs of the invention and properly and fixedly secured relative to the ramp structure prior to and during use maintains the ramp structure in alignment with each forward wheel of an associated vehicle to thereby prevent inadvertent displacement of the ramps with attending danger and damage to an associated vehicle during use. The adjustable web structure permits a combination and positioning of the web relative to forward wheels of a vehicle in a manner not presently directed by the prior art, and sets forth a combination to ensure the proper alignment and positioning of the ramps relative to an associated vehicle.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vehicular ramp apparatus comprising, in combination, a right side wall spaced from and parallel to a left side wall and a rear wall fixedly and orthogonally mounted to the right and left side walls at respectively right and left rear terminal vertical edges of the right and left side walls, and a horizontal top ramp mounted within the side walls and rear wall orthogonally and fixedly secured between the side walls and the rear wall, and an inclined ramp orthogonally mounted between the side walls coextensively secured to the top ramp, wherein the inclined ramp includes a forward ramp edge at a lower terminal end of the inclined ramp, wherein the forward ramp edge is orthogonally positioned between the right and left side wall, and a fabric web underlying the top ramp and the inclined ramp and positionable forwardly of the forward ramp edge, where the fabric web is oriented between the right and left side walls, and a right support flange and a left support flange mounted to opposed side edges of the rear wall, wherein the right and left flanges are orthogonally and fixedly mounted to the rear wall and support a roll support axle therebetween, wherein the axle is arranged parallel to the rear wall and orthogonally oriented relative to the side walls, and a web roll rotatably mounted about the roll support axle, wherein the fabric web extends from the web roll below the rear wall, and further including a right and left support leg mounted to the respective right and left side wall extending below the respective right and left side walls adjacent the rear wall, wherein the fabric web extends between the right and left leg, and a presser plate, where the presser plate is mounted between the right and left side walls extending forwardly of the forward ramp edge, wherein the presser plate is longitudinally aligned with the fabric web.

2. An apparatus as set forth in claim 1 wherein the presser plate includes a respective right and left ear, wherein the right and left ears each include a cylindrical opening, wherein each cylindrical opening is coaxially aligned relative to one another, and a respective right and left support axle is directed through each respective right and left ear secured to a respective right and left side wall.

3. An apparatus as set forth in claim 2 wherein the presser plate is defined by a predetermined thickness and each leg is defined by a predetermined height, wherein the predetermined thickness is substantially equal to that of the predetermined height.

4. An apparatus as set forth in claim 3 wherein the presser plate extends below the inclined ramp from the forward ramp edge.

* * * * *